United States Patent [19]

Hull et al.

[11] Patent Number: 5,028,765

[45] Date of Patent: Jul. 2, 1991

[54] GIVE-A-WAY AND CRIBBAGE GAME BOARD

[76] Inventors: Harold L. Hull, 401 Canyon Way #43, Sparks, Nev. 89434; Michael L. Maxfield, 475 Colt Dr., Reno, Nev. 89506; William L. Durante, Jr., P.O. Box 243, Ranchester, N.Y. 82839

[21] Appl. No.: 507,635

[22] Filed: Apr. 11, 1990

[51] Int. Cl.[5] ..... A63F 1/18

[52] U.S. Cl. ..... 235/90; 273/148 A

[58] Field of Search ..... 235/90; 273/148 A

[56] References Cited

U.S. PATENT DOCUMENTS

| | | | |
|---|---|---|---|
| 1,320,798 | 11/1919 | Salambo | 273/148 A |
| 2,513,219 | 6/1950 | Tweed | 273/148 A |
| 3,347,460 | 10/1967 | Dickson | 235/90 |
| 3,905,547 | 9/1975 | Cyre et al. | 235/90 |
| 4,332,386 | 6/1982 | Townsend | 235/90 X |
| 4,477,719 | 10/1984 | Watterson | 235/90 |
| 4,521,675 | 7/1985 | Yakich | 235/90 |

*Primary Examiner*—Brian W. Brown

[57] ABSTRACT

The present invention is a peg type score keeping game board which is two game boards in one and is specifically suited by design to facilitate card games such as the game GIVE-A-WAY and CRIBBAGE.

7 Claims, 2 Drawing Sheets b
b
a
a
10
12
14
16
18
20
22
24
26
28
30
32
34

GIVE-A-WAY AND CRIBBAGE GAME BOARD

FIELD OF THE INVENTION

The present invention relates to game boards and more particularly to peg type score keeping game boards which are specifically suited by design to facilitate card games such as GIVE-A-WAY and CRIBBAGE.

BACK GROUND OF THE INVENTION

In the past, several game boards have been taught such as U.S. Pat. Nos. 4,477,719, 4,521,675 and 4,332,386. However none of these prior art game boards are suitable for the game GIVE-A-WAY. These prior art game boards do not provide the proper amount of holes nor do they provide specific locations on the board which are designated for specific aspects of the game GIVE-A-WAY. Also none of the above mentioned game boards provide a game board on "both sides" of the board as does the present invention.

Rules and instructions for the game GIVE-A-WAY need now be explained in order to exhibit the necessity for the present invention.

NUMBER OF PLAYERS: Two or three, or four as partners.

THE PACK: 52 cards.

RANK OF CARDS: K (High),Q,J,10,9,8,7,6,5,4,3,2,-1,A.

THE DRAW: Highest card deals. Players drawing cards of the same rank must draw again.

THE SHUFFLE AND CUT: Dealer will shuffle last. The player will cut each hand.

THE DEAL: (Two hand) Each player receives six cards, dealt one at a time. Players deal alternately during the game. Winner of a game deals first for the next game.

GIVE-A-WAY: Each player looks at his six cards and lays away two of them to reduce his hand to four. The four cards laid away together constitute giveaway, which belongs to the dealer but is not exposed or used until after the play.

THE STARTER: After the giveaway is laid away, non-dealer cuts the pack and dealer turns up the top card of the lower pack. This card, placed up on the pack, is the starter. If the starter is a jack, non-dealer backs up 2 pegs at once. The starter is not used in the play.

THE PLAY: After the starter is turned, non-dealer lays one of his cards face up on the table. Dealer similarly exposes a card. Then non-dealer again, and so on. The cards are exposed card by card, alternately except for go's as noted below. Each player keeps his cards separate from those of his opponent.

As each plays, he announces the total of points reached by the addition of his card to those previously played. Example; non-dealer begins with a 4, saying "Four". Dealer plays a 9, saying "Thirteen".) The kings, queens and jacks count 10 each; every other card counts its point value (ace being one).

THE GO: During the play, the running total of cards may never be carried beyond 31. If a player is unable to add another card without exceeding 31, he says "Go" and his opponent pegs 1. But the player gaining the go must first lay down any additional cards he can without exceeding 31. If a pair or runs are played, then the player must peg those points, in addition to his GO. If a player reaches exactly 31 he pegs 2 instead of 1 for go.

The player who called "Go" must lead for the next series of play, the count starting at zero. The lead may not be combined with any cards previously played to form a scoring combination, the go having interrupted the sequence.

Playing the last card of all, pegs 1 for go, plus 1 extra if it brings the count to exactly 31. The dealer is sure to peg at least 1 point in every hand, for he will have a go on the last card if not earlier.

POINT SYSTEM FOR PLAY

FIFTEEN. For adding a card that makes the total 15, peg 2.

PAIR. For adding a card of the same rank as that played previously, peg 2. (Note that face cards pair only by actual rank, jack with jack, but not jack with queen.)

TRIPLET (Also called Double Pair or Double Pair Royal). For adding the fourth card of the same rank, peg 12.

RUN: (Sequence). For adding a card which forms, with those played last previously, a sequence of three or more, peg 1 for each card in the sequence. (Runs are independent of suits, but go strictly by rank, e.g., 9-1-0-Q is not.)

It is necessary to keep track of the order in which cards are played to determine whether what looks like a pegging formation is interrupted by a foreign card. Examples; Cards are played in this order; 8,7,7,6. Dealer pegs 2 for fifteen, and opponent pegs 2 for pair, but dealer cannot peg for run because of the extra sevenspot. Again, cards are played in this order; 9,6,8,7. Dealer pegs 2 for fifteen on his first play, but can't count the sequence because the sequence must be in direct order, (e.g. 9,6,8,7 is not in sequence, 1,2,3,4 is a sequence.)

A sequence of (7,8,9) counts 3 pegs; a sequence of (1,2,3,4) counts 4 pegs, etc.

COUNTING THE HANDS: When the play ends the three hands are counted in order; non dealer (first), dealers hand, giveaway. This order is important, for toward the end of a game, the non-dealer may "Count out" and lose before dealer has a chance to count, even though the dealers total would have exceeded that of his opponent.

The starter is considered to be a part of each hand, so that all hands in counting comprise five cards. Following are the basic formations of scoring value;

FIFTEEN: Each combination of cards that totals 15 counts 2.

PAIR: Each pair of cards of the same rank counts 2.

RUN: Each combination of three or more cards in sequence counts 1 for each card in the sequence.

FLUSH: Four cards of the same suit in hand (not giveaway, and not including starter,)

JACK OF SUIT: Jack of the same suit as starter counts 1.

COMBINATIONS: In the above table, the word combination is used in the strict technical sense. Each and every combination of two cards that make a pair, of two or more cards that make 15, or three or more cards that make a run, count separately. Example; A hand (with starter) of 8,7,7,6,2 scores 8 points for four combinations that total 15; The 8 with one 7, and with the other 7; the 6-2 with each 7 in turn. It scores 2 for pair, and 6 for two runs of three 8-7-6 using each seven in turn. The total is 16. An experienced player computes the hand thus; "Fifteen 2, fifteen 4, fifteen 6, fifteen 8, and 8 for double run is 16."

A TRIPLET: Counts 6.

FOUR OF A KIND: Counts 12.

A RUN OF THREE: With one card duplicated, (double run), counts 8.

A RUN OF FOUR: With one card duplicated, counts 10.

A RUN OF THREE: With one card triplicate (triple run), counts 15.

A RUN OF THREE: With two different cards duplicated, counts 16.

The following list includes many of the hands the beginner may find some difficulty in counting;

| GIVEAWAY SCORES: | |
|---|---|
| 1-1-2-2-3 = 16 | 2-6-7-7-8 = 16 |
| 1-2-3-3-3 = 15 | 6-7-8-9-9- = 16 |
| 1-4-4-4-10 = 12 | 3-3-6-6-6- = 20 |
| 2-3-4-4-4- = 17 | 3-3-3-4-5- = 21 |
| 2-2-3-3-4 = 16 | 1-1-7-7-8 = 12 |
| 2-3-3-3-4 = 17 | 3-3-3-6-6 = 18 |
| 3-3-4-4-5 = 20 | 3-3-6-6-9 = 14 |
| 3-4-4-4-5 = 17 | 5-5-5-n-j = 23 |
| 3-4-4-5-5 = 16 | 5-5-5-10-10 = 22 |
| 3-6-6-6-6 = 24 | 1-4-4-n-4 = 13 |
| 4-4-5-6-6 = 24 | 5-5-10-n-q = 18 |
| 4-5-5-6-6 = 24 | 2-2-2-2-9 = 20 |
| 4-5-6-6-6- = 21 | 3-3-3-3-9 = 24 |
| 5-n-5-5-5- = 29 | 3-3-3-3-6 = 20 |
| 5-5-5-5-10 = 28 | 4-4-4-4-7 = 24 |
| 5-5-10-J-Q = 28 | 4-4-4-4-7 = 24 |
| 5-5-5-5-10 = 28 | 1-7-7-7-7 = 24 |
| 6-6-9-9-9 = 20 | 4-4-4-7-7 = 20 |
| 6-9-9-9-9- = 20 | 4-4-7-7-7- = 14 |
| 6-6-7-7-8 = 20 | 3-3-4-5-5 = 20 |
| 7-7-7-8-9 = 21 | 1-1-6-7-7 = 12 |
| 7-7-7-8-6 = 21 | 2-6-6-7-7- = 12 |
| 7-7-7-8-8 = 20 | 7-7-7-1-1 = 20 |
| 7-8-8-8-8 = 20 | 3-4-4-4-4- = 20 |
| 7-7-8-8-9 = 24 | 5-5-5-4-6- = 23 |
| 7-8-8-9-9 = 20 | 1-1-6-7-8 = 13 |
| 5-5-N-J-J = 21 | |

No hand can make a count of 19, 25, 26, or 27.

At the end of play, non-dealer counts first. Each hand is verified by all players.

GAME: Game is fixed at 151 points or 116 points. If the trap door comes into play, the game ends the moment a player reaches the total points or when the trap door is used.

SKUNK: Each game counts 1 for winning. A Skunk counts 2 games. If a player keeps from passing 126 pegs by the time his opponent reaches the finish hole he has skunked his opponent.

TRAP-DOOR: At 116 pegs from start you will find the trap door. The player having the most pegs from the start is losing the game and if he lands on the trap door after his count in his hand, he instantly wins.

The player having the least pegs from the start is winning the game and if he lands on the trap door after his count in his hand he instantly loses.

If both players land on the trap door in the same hand, the play continues. The giveaway is not used as part of this count.

GLORY-HOLE: Located just before the finish hole. If Dealer or Non-dealer lands in the glory hole by the end of pegging play and count, then the point count that is in their hand moves them backward that amount. If the dealer hits the glory hole, the points in the giveaway are also added for backward movement.

VARIATION: The dealer is in the glory hole; Total hand count is 15–2. He pegs out to finish the hole for 1 and back in for 1.

Now he totals his qiveaway hand for 4, and he pegs backward four pegs, and the game continues.

The same applies for non-dealer, except he does not have the giveaway hand.

4 PLAYER: Partners are determined by cutting the cards. The two high are together, and the two low cards are together. Total point counts for teams are added together and pegged like two-handed giveaway. All other rules apply.

NADA: A no count in the players hand, move backward 2 pegs.

A no count in the giveaway hand, move backward 4 pegs.

This is called a NADA.

SUMMARY OF THE INVENTION

It is the primary object of the present invention to provide a peg type score keeping game board which is specifically suited by design to facilitate card games such as GIVE-A-WAY and CRIBBAGE.

It is a further object of the present invention to provide a game board which is two game boards in one. Wherein one side is used for the game GIVE-A-WAY and the other side is used for CRIBBAGE.

It is still a further object of the present invention to provide a game board wherein the board is designed to hold cards and pegs for storage.

Other objects and advantages will become obvious when taken into consideration with the following drawings and specifications.

DETAILED DESCRIPTION OF THE DRAWINGS

Figure 1:
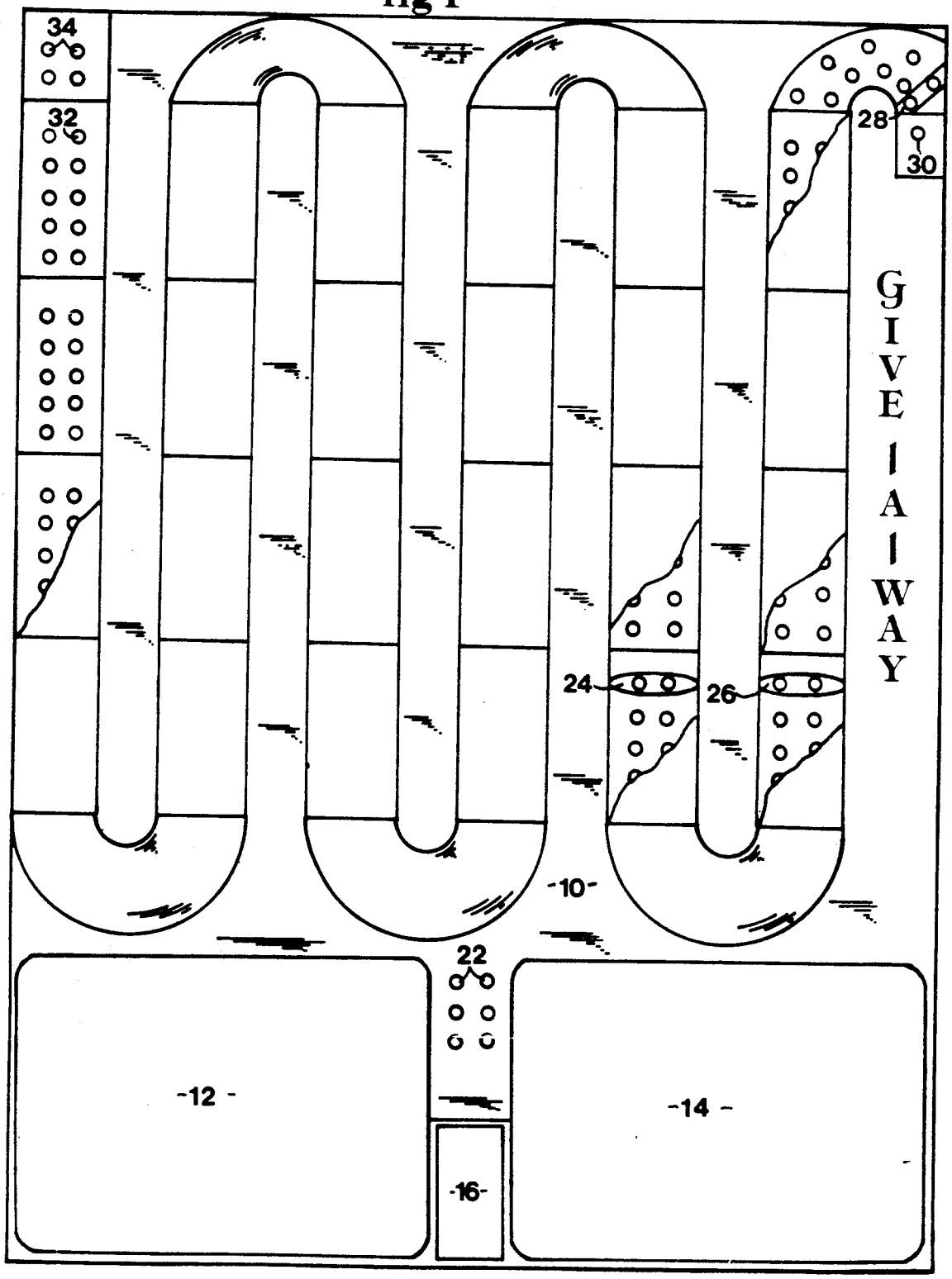
FIG. 1 is a top view of the (GIVE-A-WAY) side of the game board.
Figures 2, 3, 4, 5, 6:
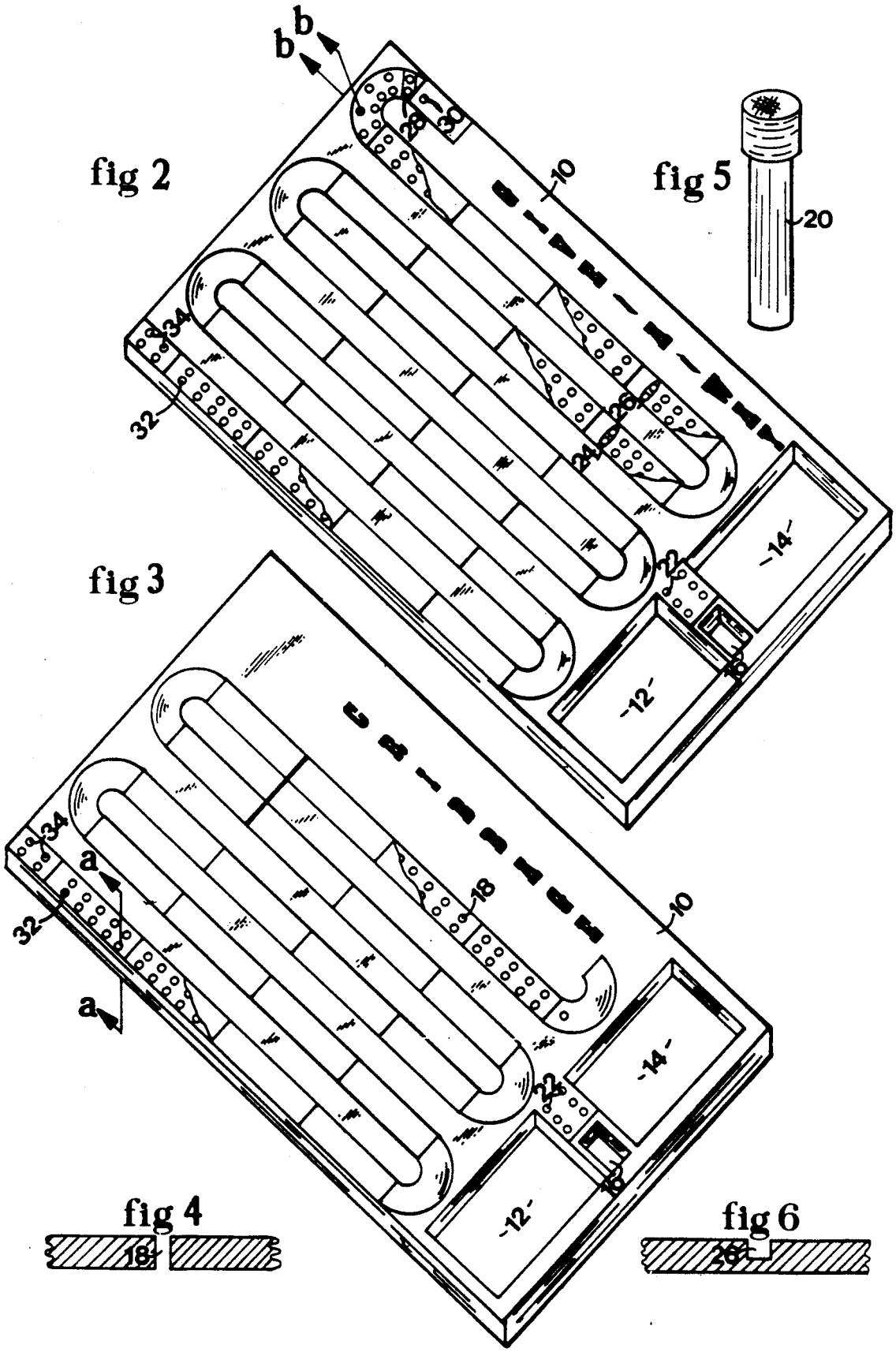
FIG. 2 is a perspective view of the game board when used for GIVE-A-WAY.
FIG. 3 is a perspective view of the game board when used for CRIBBAGE.
FIG. 4 is a section taken at a—a of FIG. 3.
FIG. 5 is a perspective view of a playing peg.
FIG. 6 is a section taken at b—b of FIG. 2.

Referring now to the drawings in detail wherein like numerals represent like parts, 10 is a scoreboard with 12, 14, and 16 respectively being cavities which extend through the score board 10, 12 and 14 being substantially the size of the box for playing cards, while 16 is substantially the size of a small match box. The thickness of the score board 10 is substantially the same thickness as a deck of cards in its carrying case and becomes a holder for the card carrying case, while 16 becomes a holding box for pegs, 18 are tally pin holes to retain the tally pins 20; with 22 being additional score keeping holes on the CRIBBAGE side, there are 121 playing holes, while on the GIVE-A-WAY side there are 151 playing holes, the 121 holes may be matched with the corresponding holes on the GIVE-A-WAY side, while the remaining holes on the GIVE-A-WAY side may be partially drilled, 24 are markings to indicate the 116th hole which in the game is called the trap door, while 26 is the 126th hole which in the game indicates skunk, while 28 is the hole just before the finish hole 30, which in the game is called the glory hole, 32 is the start holes, 34 are back up holes and 36 being holes which do not extend all the way through the board.

It will now be seen that we have provided a score keeping game board which is specifically suited by design to facilitate card games such as the new game GIVE-A-WAY and CRIBBAGE.

It will also be seen that we have provided a score keeping game board which has indica for specific aspects of the new game GIVE-A-WAY such as the "glory hole", the "trap door", "skunk", the name "GIVE-A-WAY", "start" and "finish" and on the CRIBBAGE side indica such as the name "CRIBBAGE", "start", "finish" and "skunk".

It will further be seen that we have provided a score keeping game board which has cavities designed to capture, embrace and holds a carrying case for cards for storage and a peg box such as a small match box for storage of pegs.

It will also be seen that we have provided a score keeping game board which is two boards in one, wherein the new game GIVE-A-WAY can be played on one side and CRIBBAGE can be played on the other side.

It will also be seen that we have provided a score keeping game board which is new and unusual in manner.

Although the invention has been herein shown and described in what is conceived to be the most practical and preferred embodiments, it is recognized that departures may be made therefrom within the scope of the invention which is not to be limited to the details disclosed herein but it is to be accorded the full scope of the claims so as to embrace any and all equivalent devices and apparatus.

What we claim is:

1. A combination CRIBBAGE and GIVE-A-WAY Game Board comprising; an elongated board, said board being constructed from one piece of material, said board having first and second sides, said first side being a score board for the game of CRIBBAGE, said second side being a score board for the game of GIVE-A-WAY, at least two tally pins, said first and second sides having a plurality of spaced, parallel rows of tally pin holes being arranged in two sequences, said tally pins cooperating with said tally pin holes, said first side having indica pertinent to said game of CRIBBAGE, said second side having indica pertinent to said game of GIVE-A-WAY, said tally pin holes of said first side of said game board being of sufficient number to play said game of CRIBBAGE, said tally pin holes of said second side of said game board being of sufficient number to play said game of GIVE-A-WAY, said tally pin holes of said first side being of a lessor number than said tally pin holes of said second side, said tally pin holes of said first side registering with said tally pin holes of said second side, said game board having at least a first and second rectangular opening, a playing card box, a tally pin box, said first rectangular opening cooperating with said playing card box to frictionally engage and hold said playing card box and said second rectangular opening cooperating with said tally pin box to frictionally engage and hold said tally pin box.

2. The device of claim 1 in which said first and second sides of said game board are substantially planar.

3. The device of claim 1 in which said first and second sides of said game board contain extra tally pin holes for game tally keeping.

4. The device of claim 1 in which said material is wood.

5. The device of claim 1 in which said material is plastic.

6. The device of claim 1 in which said indica on said first side of said game board include "CRIBBAGE", "SKUNK" "START" and "FINISH".

7. The device of claim 1 in which said indica on said second side of said game board include "GIVE-A-WAY" "START" "SKUNK" "TRAP DOOR" "GLORY HOLE" and "FINISH".

* * * * *